United States Patent [19]

Schwitters

[11] Patent Number: 4,532,835

[45] Date of Patent: Aug. 6, 1985

[54] BI-DIRECTIONAL FILTER WRENCH

[75] Inventor: Brian M. Schwitters, Clara City, Minn.

[73] Assignee: Parker-Hannifin Corporation, Cleveland, Ohio

[21] Appl. No.: 607,540

[22] Filed: May 7, 1984

[51] Int. Cl.[3] ..... B25B 13/18

[52] U.S. Cl. ..... 81/128

[58] Field of Search ..... 81/128, 129

[56] References Cited

U.S. PATENT DOCUMENTS

| | | | |
|---|---|---|---|
| 2,884,826 | 5/1959 | Bruhn | 81/128 |
| 3,119,290 | 1/1964 | Ivie | 81/128 |
| 3,209,624 | 10/1965 | Shiftman | 81/128 |
| 4,436,004 | 3/1984 | Chang | 81/128 |

*Primary Examiner*—James L. Jones, Jr.
*Attorney, Agent, or Firm*—Joseph B. Balazs

[57] ABSTRACT

A wrench for installing or removing filter cartridges in locations of limited access, consists of a pair of joined sheet metal stampings having cartridge engaging flanges thereon, arranged to be drawn together by a cam and slot mechanism, operated by an axially applied tool. The stampings are slidably pinned together for limited relative movement. One of the stampings supports the cam for revolution while the other stamping includes a transverse slot in which the cam is disposed to effect the relative movement. The cam and slot are arranged so that inward clamping movement and thus gripping of the cartridge occurs upon revolution of the cam in either direction.

7 Claims, 4 Drawing Figures

BI-DIRECTIONAL FILTER WRENCH

BACKGROUND OF THE INVENTION

This invention describes an oil filter wrench for installing and removing filter cartridges in limited access locations on automobiles and the like.

There are many versions of oil filter wrenches currently available, the most popular of which provides a strap for encircling the filter cartridge and a handle for tightening the strap and providing torque thereto. The strap form of tool is inexpensive and advantageous in that it spreads the gripping force about the complete periphery of the cartridge and can achieve the necessary gripping force without damaging the typical thin sheet metal container of most filter cartridges. This form of tool is also convenient in that it can accommodate a fairly wide range of cartridge sizes. Recently however, engine compartments have become more crowded and it is difficult to maneuver this type of tool both in gaining access to the cartridge and applying the necessary torque thereto.

Other forms of tools have been devised to accommodate this situation. One form is described in U.S. Pat. No. 3,119,290 wherein a socket-like tool is provided for accessing the filter cartridge axially, similar to a socket wrench and where torque is applied generally along the axis of the filter cartridge, rather than at the periphery in the strap type of tool. In the socket form of tool described, the socket portion is formed in two halves which may be drawn together by a cam and slot arrangement to engage and grip the periphery of a filter cartridge and provide removal torque.

SUMMARY OF THE INVENTION

The instant invention is an improvement on the socket type of oil filter cartridge gripping tool and provides a universal tool which can be used with a wide size range of filter cartridges and which can effect both installation and removal torque.

The tool consists of a pair of sheet metal stampings which are generally symmetrical, each including a flat base portion and an upturned end which has a pair of cartridge-engaging flanges thereon. The base portions are arranged in overlapping sliding engagaement so that the pairs of flanges may be drawn linearly toward one another. This closes the sides of the socket to grip and engage the filter cartridge as torque is applied to the tool at an axial location thereon. Torque is applied by means of a socket wrench or the like, to a nut at the lower end of the tool, which is a part of a cam and slot arrangement for moving the stampings together or apart depending upon the direction of rotation of the nut. It is a particular advantage of this tool that the stampings can be drawn together upon either clockwise or counter-clockwise rotation of the nut for installation or removal purposes respectively. It is a further advantage of this tool that the filter cartridge can be provisionally gripped and supported by the tool during the installation procedure.

DESCRIPTION OF THE INVENTION

Figure 1:
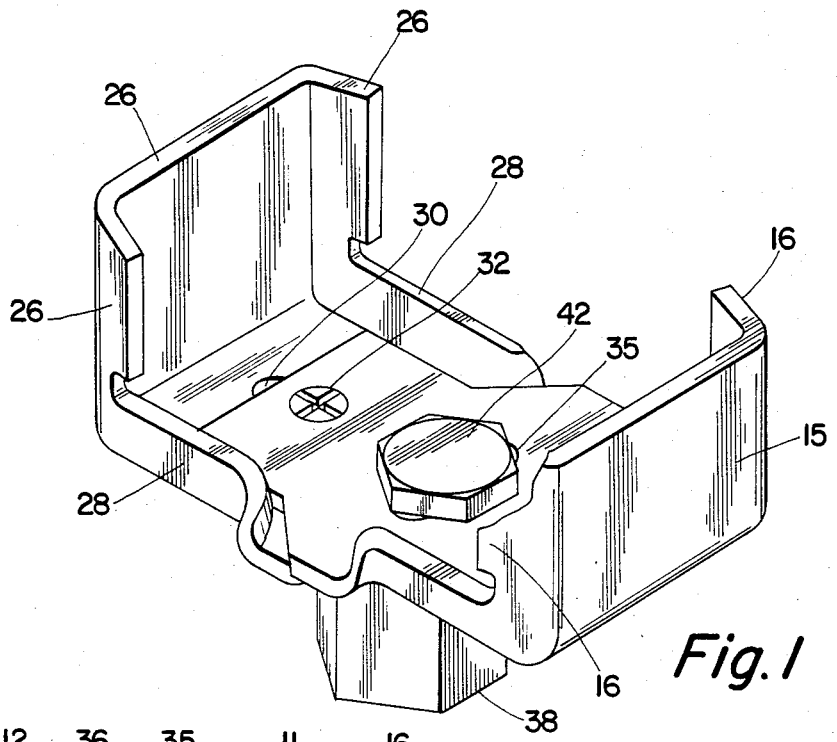
FIG. 1 is a perspective view showing the filter wrench of the invention in the open position.

Referring now to the drawings, there is shown a preferred embodiment of filter wrench 10 consisting essentially of upper metal stamping 11 and lower metal stamping 12. Upper stamping 11 is formed of a generally rectangular sheet of metal in a stamping operation and includes flat base portion 14 and bent upturned end 15. At either side of upturned end 15 are bent flanges 16 which form a pair of flanges movable with upper stamping 11. Bent webs 18 may be included at either side of base portions 14, integral in part with upturned end 15 to add strength and rigidity to the structure of upper stamping 11.

Lower stamping 12 is generally symmetrical with upper stamping 11 and includes the similar components of base portion 24, upturned end 25, pair of flanges 26 and strengthening webs 28. In assembled position, upper stamping 11 is nested within lower stamping 12 with upper base portion 14 adjacent lower base portion 24. One end of upper base portion 14 is narrowed to fit between lower webs 28. The corresponding end of lower base portion 24 is also narrowed in a similar manner to maintain symmetry of the stamping 11, 12, allowing a common forming die to be utilized.

Lower stamping 12 includes a spaced pair of slots 30 aligned with one another, elongated in the longer dimension of lower base portion 24, and positioned generally in the center of base portion 24. Upper stamping 11 includes a corresponding pair of holes 31 in base portion 14 in registry with slots 30 and which receive fasteners such as rivets 32 for slidably securing the respective base portions 14, 24. Upper and lower stampings 11, 12 thus are arranged for limited linear sliding movement relative to one another with rivets 32 fixed in holes 31 for movement with upper stamping 11 and limiting movement by engagement with the sides and either end of slots 30. In this movement, the pairs of flanges 16, 26 are moved toward or away from one another for releasable engagement with a filter element cartridge disposed therebetween.

Upturned ends 15, 25 are bent at approximately a ninety degree angle to respective base portions 14, 24 and extend upwardly about one-half the length of the base portions. Flanges 16, 26 are bent from ends 15, 25 backwardly in the direction of base portions 14, 24, but are slightly flared outwardly. Flanges 16, 26 extend almost the full length of ends 15, 25 and are arranged to be moved in a line toward and away from one another, in the manner of a socket which can be opened and closed along a vertical split therethrough. Flanges 16, 26 thus serve to engage and grip the periphery of a filter cartridge either at a smooth outer surface thereof or at flutes which may be provided in the cartridge.

Figure 3:
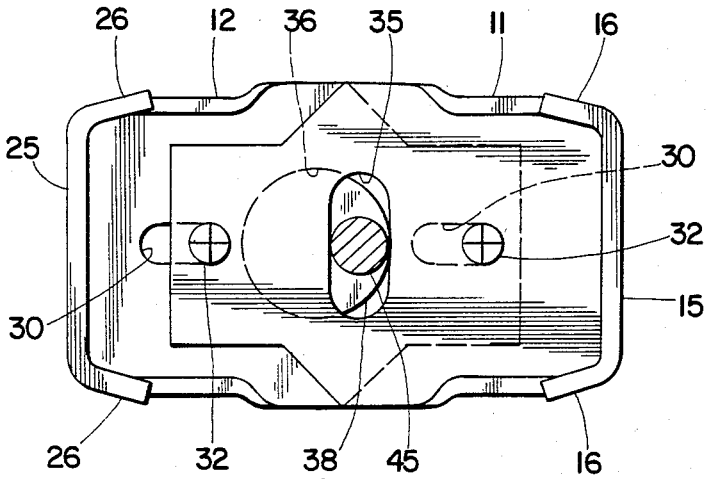
FIG. 3 is a plan view of the filter wrench of FIG. 1, shown in the open position and with parts removed, for clarity.
Figure 4:
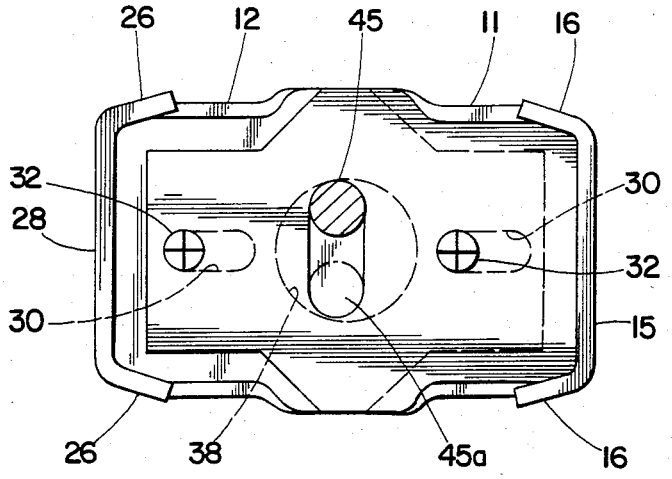
FIG. 4 is a plan view of the filter wrench of FIG. 1, shown in the closed position and with parts removed, for clarity.
Figure 2:
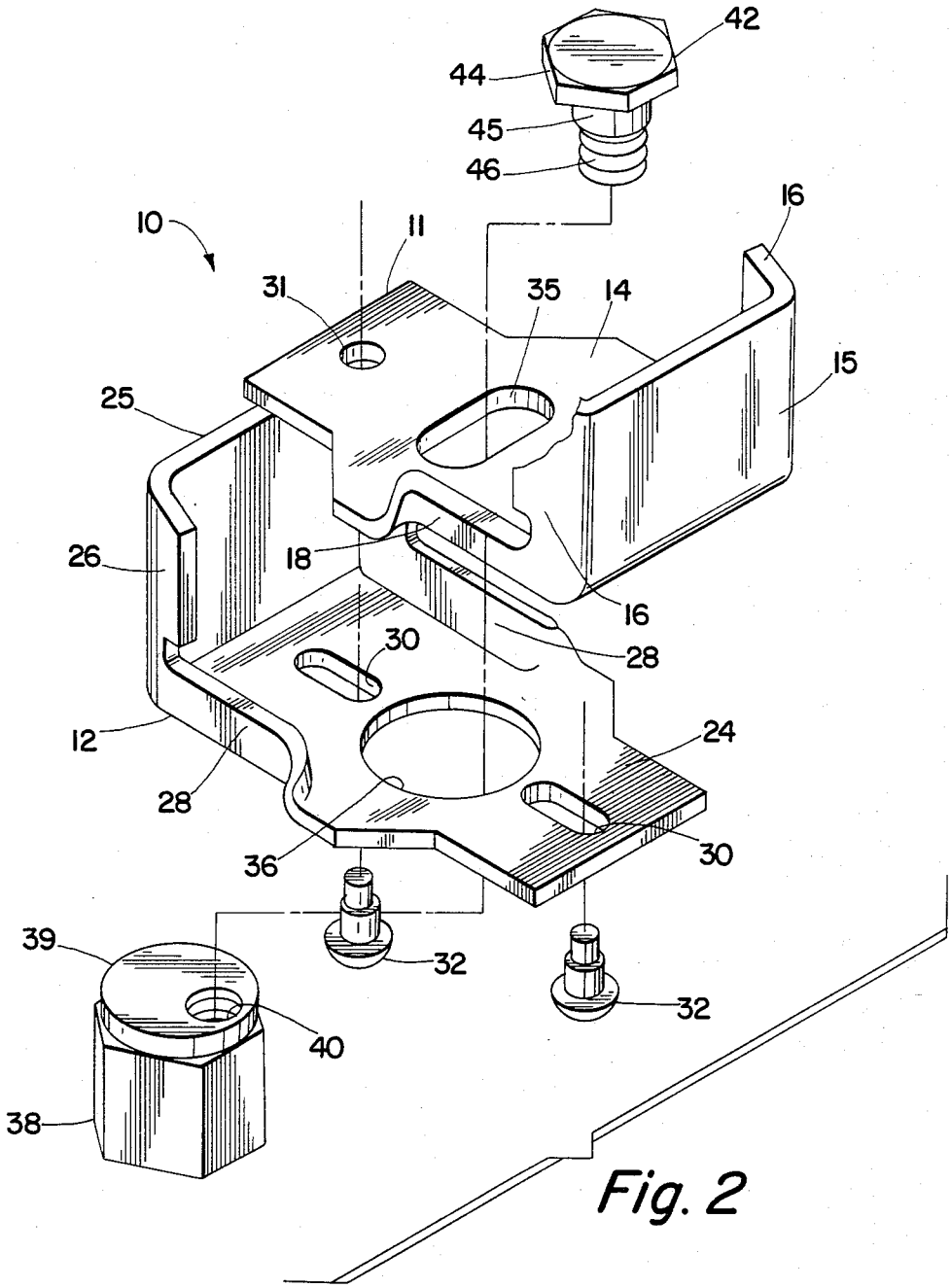
FIG. 2 is an exploded view of the filter wrench of FIG. 1.

Flanges 16, 26 are moved together or apart by means of a cam and slot interconnection between upper and lower stampings 11, 12. Upper stamping 11 includes a slot 35 between holes 31 in the middle of base portion 14, which slot 35 is enlongated in a transverse direction. Lower stamping 12 includes circular opening 36, between slots 30 and in transverse registry with slot 35 as best seen in FIGS. 3 and 4 but offset linearly. Nut 38, having a short circular peripheral portion 39 of a dimension approximately the thickness of lower base portion 24, is slidably received in circular opening 36 for rotation therein. Nut 38 includes axially extending, offset, threaded bore 40, which receives shoulder bolt 42, the latter forming the cam of the cam and slot mechanism. Bolt 42 includes hex head 44, smooth shoulder 45 and threaded end 46 and is passed through slot 35 into threaded bore 40 or nut 38. Shoulder 45 is the cam portion of bolt 42 and is sized slightly greater than the thickness of upper base portion 14 so that bolt 42 can be securely fastened to nut 38 and yet allow free sliding movement between upper and lower stampings 11, 12. In this embodiment of the invention, stampings 11, 12 are formed of eleven gauge cold rolled steel and thus base portions 14, 24 are on the order of one-eighth inch thickness.

The cam and slot mechanism is best seen in FIGS. 3 and 4 in which stampings 11, 12 are in full open and full closed positions, respectively. Transverse slot 35 is of a width substantially the same as the diameter of circular opening 36 and is sized to slidably receive shoulder 45 of bolt 42. Bolt 42 is sectioned through shoulder 45 in FIGS. 3 and 4 for purposes of clarity, and may be visualized as coincident with threaded bore 40 in nut 38, as seen through slot 35. In the full open position of FIG. 3, nut 38 has been rotated to place shoulder 45 in line with slots 30, which through engagement between shoulder 45 and transverse slot 35 has moved upper stamping 11 to the right to its full open position. Shoulder 45 is in the center of transverse slot 35 at this location and rivets 32 may be in engagement with the right hand ends of linear slots 30.

As nut 38 is rotated in the clockwise direction, as viewed from the bottom of wrench 10, shoulder 45 will revolve to the position depicted in full lines in FIG. 4. Shoulder 45 will engage slot 35 and move upper stamping 11 to the full closed position of FIG. 4. Movement is limited by abutment of rivets 32 with the opposite ends of linear slots 30. During such movement, upturned ends 15, 25 could be placed adjacent the periphery of a filter cartridge so as to engage and grip the periphery of the cartridge before upper stamping 11 has reached the full closed position of FIG. 4. Continued urging of nut 38 in the clockwise direction would thus continue to grip such cartridge and apply torque thereto so that the cartridge could be provisionally supported thereby and be threaded into engagement with a receiving structure.

It will be apparent that a similar action obtains if nut 38 is rotated in a counter-clockwise direction from the full open position of FIG. 3, except that shoulder 45 will be moved to the position depicted at **45*a* and shown in dashed lines in FIG. 4. In this position as well, shoulder 45*a* has engaged slot 35 and moved upper stamping 11 to the left or full closed position, with movement again being limited by inter-engagement between rivets 32 and linear slots 30. In this mode, upturned ends 15, 25 would engage and grip a filter cartridge placed therebetween and apply unthreading torque thereto. Thus it will be clear that a bi-directional operation of filter wrench 10 is obtained to provide installation or removal torque for filter cartridges, dependent upon direction of rotation of operating nut 38**.

We claim:

1. A universal oil filter wrench for installing and removing filter cartridges from limited access locations in automobiles and the like, comprising:

an upper sheet metal stamping of generally rectangular configuration having a flat base portion and an upturned end, a first pair of flanges at the sides of said upturned end on said upper stamping, a lower sheet metal stamping of generally rectangular configuration having a flat base portion and an upturned end, a second pair of flanges at the sides of said upturned end on said lower stamping, said first and second pairs of flanges being lateral edge portions of said upturned ends bent backwardly toward said respective base portions and flared outwardly of said upturned ends, a pair of slots in said base portion, said slots being elongated in the direction of said upturned end, a pair of fasteners in said slots interconnecting said upper and lower stampings for limited linear relative sliding movement over one another thereby allowing movement of said upturned ends toward and away from one another to move said pairs of flanges in a line toward one another for engagement with the generally cylindrical peripheral surface of an oil filter cartridge, a circular opening in said lower stamping intermediate said pair of slots, a further slot in said upper stamping elongated in a transverse direction and overlying said circular opening, a nut having a cylindrical peripheral portion rotatably disposed in said circular opening, and a cam member eccentrically located on said nut for rotation therewith and extending into said transverse slot for moving said upper stamping outwardly and inwardly relative to said lower stamping upon both clockwise and counter-clockwise rotation of said nut.

2. An oil filter wrench as set forth in claim 1 wherein said upper and lower stampings are symmetrical and said respective base portions are in overlapping sliding engagement with one another.

3. An oil filter wrench as set forth in claim 2 wherein said cam member is a shoulder bolt in threaded engagement with said nut and serves to retain said nut in said circular opening.

4. An oil filter wrench as set forth in claim 3 wherein said upturned ends of said sheet metal stampings are bent from said respective base portions at substantially a ninety degree angle so as to be positionable adjacent the cylindrical periphery of an oil filter cartridge.

5. An oil filter wrench as set forth in claim 4 wherein said upturned ends extend upwardly from said respective base portions approximately one-half the length of said base portions so as to be positionable adjacent the cylindrical periphery of an oil filter cartridge.

6. An oil filter wrench as set forth in claim 5 wherein said flanges extend substantially the same length as said end portions.

7. An oil filter wrench as set forth in claim 6 wherein said stampings are formed of eleven gauge cold rolled steel.

* * * * *